US006959523B2

(12) United States Patent
Reynolds

(10) Patent No.: US 6,959,523 B2
(45) Date of Patent: Nov. 1, 2005

(54) PROCESS FOR AUTOMATING THE ATTACHMENT OF A CLIP TO A PRODUCT

(75) Inventor: Gary M Reynolds, Keller, TX (US)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 81 days.

(21) Appl. No.: 10/243,394

(22) Filed: Sep. 13, 2002

(65) Prior Publication Data

US 2004/0050019 A1 Mar. 18, 2004

(51) Int. Cl.[7] ..... B65B 51/00
(52) U.S. Cl. ..... 53/417; 53/139.2; 53/133.4
(58) Field of Search ..... 53/417, 139.2, 53/133.4; 493/212, 213, 214, 371, 374, 383

(56) References Cited

U.S. PATENT DOCUMENTS

| | | | |
|---|---|---|---|
| 381,265 | A | 4/1888 | Martens |
| 1,459,735 | A | 6/1923 | Kraft |
| 2,589,577 | A | 3/1952 | Rosenthal et al. |
| 2,898,744 | A | 8/1959 | Robbins |
| 3,036,506 | A | 5/1962 | Andresen, Jr. |
| 3,095,291 | A | 6/1963 | Robbins |
| 3,149,943 | A | 9/1964 | Amador |
| 3,171,184 | A | 3/1965 | Posse |
| 3,247,852 | A | 4/1966 | Schneider |
| 3,259,302 | A | 7/1966 | Rocchisani |
| 3,461,876 | A | 8/1969 | Miller, Jr. |
| 3,523,534 | A | 8/1970 | Nolan |
| 3,542,032 | A | 11/1970 | Spencer, Jr. |
| 3,551,965 | A | 1/1971 | Gordon |
| 3,621,539 | A | 11/1971 | Ayers |
| 3,669,115 | A | 6/1972 | Melges |
| 3,735,765 | A | 5/1973 | Ichelson |
| 3,785,111 | A | 1/1974 | Pike |
| 3,807,118 | A | 4/1974 | Pike |
| 3,865,117 | A | 2/1975 | Perry, III |
| 3,874,042 | A | 4/1975 | Eddleman et al. |
| 3,900,989 | A | 8/1975 | Weisenthal |
| 3,950,158 | A | 4/1976 | Gossett |
| 4,038,726 | A | 8/1977 | Takabayashi |
| 4,057,047 | A | 11/1977 | Gossett |
| 4,212,303 | A | 7/1980 | Nolan |

(Continued)

FOREIGN PATENT DOCUMENTS

| | | |
|---|---|---|
| DE | 9401613 | 3/1994 |
| DE | 29916111 U1 | 12/1999 |
| EP | 1169984 A1 | 1/2002 |
| JP | 63-67262 | 3/1988 |
| JP | 10-236487 | 9/1998 |
| WO | WO 98/18991 | 5/1998 |
| WO | WO 99/52779 | 10/1999 |
| WO | WO 03/029092 | 4/2003 |

OTHER PUBLICATIONS

DE Abstract, DE 29916111 U1, Dec. 9, 1999.

*Primary Examiner*—Scott A. Smith
*Assistant Examiner*—Brian Nash
(74) *Attorney, Agent, or Firm*—Scott B. Garrison

(57) ABSTRACT

The invention relates to a process for automating the positioning and fastening of a clip to a pouch. The system describes automated assembly of first and second clip members having ends, clamping surfaces, latching components, and hinge components with a product. Each of the clip members are loaded into feed mechanisms and mechanically manipulated into desired orientations. The clip members are dispensed in aligned, spaced apart relation with their clamping surfaces, latching components, and hinge components disposed one toward the other with the product situated between the clamping surfaces. The invention also relates to a product created by the automated assembly of clip members with a product.

14 Claims, 5 Drawing Sheets

U.S. PATENT DOCUMENTS

| | | | | | |
|---|---|---|---|---|---|
| 4,275,485 | A | | 6/1981 | Hutchison | |
| 4,294,582 | A | | 10/1981 | Naslund | |
| 4,296,529 | A | | 10/1981 | Brown | |
| 4,347,848 | A | | 9/1982 | Hubbard et al. | |
| 4,356,599 | A | | 11/1982 | Larson et al. | |
| 4,385,950 | A | | 5/1983 | Hubbard et al. | |
| 4,397,315 | A | | 8/1983 | Patel | |
| 4,416,038 | A | | 11/1983 | Morrone, III | |
| 4,427,010 | A | | 1/1984 | Marx | |
| 4,462,224 | A | | 7/1984 | Dunshee et al. | |
| D276,596 | S | | 12/1984 | Kisha | |
| 4,506,689 | A | | 3/1985 | Fiddler | |
| 4,523,353 | A | | 6/1985 | Hubbard et al. | |
| 4,551,888 | A | | 11/1985 | Beecher | |
| 4,636,391 | A | | 1/1987 | Pike | |
| 4,668,564 | A | | 5/1987 | Orchard | |
| 4,688,564 | A | | 8/1987 | Kelly | |
| 4,709,398 | A | * | 11/1987 | Ausnit | 383/63 |
| 4,753,489 | A | | 6/1988 | Mochizuki | |
| 4,765,767 | A | | 8/1988 | Marynissen et al. | |
| 4,834,730 | A | | 5/1989 | Holtermann et al. | |
| 4,854,760 | A | | 8/1989 | Pike et al. | |
| 4,887,335 | A | | 12/1989 | Folkmar | |
| 4,896,685 | A | | 1/1990 | Lawrence | |
| 4,953,550 | A | | 9/1990 | Dunshee | |
| 4,983,172 | A | | 1/1991 | Steer et al. | |
| 5,008,980 | A | * | 4/1991 | Zimmermann | 24/30.5 R |
| 5,050,272 | A | | 9/1991 | Robinson et al. | |
| 5,125,133 | A | | 6/1992 | Morrison | |
| 5,356,426 | A | | 10/1994 | Delk et al. | |
| 5,375,300 | A | | 12/1994 | Chen | |
| 5,379,489 | A | | 1/1995 | Delk et al. | |
| 5,384,935 | A | | 1/1995 | Maier-Hunke et al. | |
| 5,390,473 | A | * | 2/1995 | Nelson et al. | 53/417 |
| 5,428,871 | A | | 7/1995 | Iosif | |
| 5,466,251 | A | | 11/1995 | Brunson et al. | |
| 5,537,724 | A | | 7/1996 | Chou | |
| 5,542,766 | A | | 8/1996 | Cadwallader | |
| 5,604,959 | A | | 2/1997 | Bowen | |
| 5,619,775 | A | | 4/1997 | Klinck | |
| 5,713,108 | A | | 2/1998 | Solomon et al. | |
| 5,735,022 | A | | 4/1998 | Niedecker | |
| 6,158,095 | A | | 12/2000 | Lassiter | |
| 6,298,526 | B1 | * | 10/2001 | Baumdicker et al. | 24/559 |
| 6,517,473 | B1 | * | 2/2003 | Cappel | 493/213 |
| 6,526,726 | B1 | * | 3/2003 | Strand et al. | 53/412 |
| 2002/0133916 | A1 | | 9/2002 | Folkmar | |

* cited by examiner

PROCESS FOR AUTOMATING THE ATTACHMENT OF A CLIP TO A PRODUCT

BACKGROUND

The present invention relates to both a process for automating the attachment of a clip or closure device to a product and a resulting article manufactured by such a process.

It is well known in the art to associate a clip or closure device with a variety of products. Some examples include product packaging, resealable pouches, flexible tubing, piping or other conduits, and fabrics. In essence many flexible, deformable materials are often associated with clips and closure devices.

In the medical field pouches containing fluids are often used for a variety of purposes. For instance, saline solutions, medical wastes, and chemical hot and cold packs are considered but a few of the uses. Similar pouches are used for phase change materials, one such example being that of an ice pack.

One possible feature that these products have in common is a clip that contains some form of clamping mechanism to capture the pouch. A hinge is often disposed in some manner on the clip enabling the clamping mechanism to move selectively from an open to a closed position. The clip is secured or maintained in a clamped position by the use of a latch mechanism.

One form of hinge commonly used to join the two clamping mechanisms or clamping jaws is a strap-like hinge, known in the art as a "living hinge". However, this construction is not easily adapted to the automated sorting and feeding of the clip and subsequent attachment of the clip to the product. Due to the inherent flexibility of the living hinge, the clamping surfaces move with respect to one another when the clip is moved through an automated assembly process. This results in a random orientation of the clip making it impractical for an automated assembly process.

As a result, clips of this construction are often manually attached to their associated products. Among other things this results in limited production capacity. As such, there exists a need for a process for automating the attachment of a clip or closure device to a product. Such a process would lend itself to automated sorting, feeding, and assembly of a finished article.

SUMMARY OF THE INVENTION

As such, one aspect of the present invention discloses a process for automating the positioning and fastening of a clip to a pouch. A first clip member having ends, a clamping surface, a latching component, and a hinge component is provided. The hinge component includes a necked region which is disposed proximate to one of the ends of the clip member. A second clip member also having a clamping surface, a latching component, and a hinge component is provided as well. Each of the clip members are loaded into feed mechanisms and mechanically manipulated into desired orientations. The clip members are dispensed in aligned, spaced apart relation with their clamping surfaces, latching components, and hinge components disposed one toward the other. A pouch having a plurality of sealed sides and an open end is positioned between the clamping surfaces and the clip members are joined together by fastening the hinge component of the first clip member to the hinge component of the second clip member. This forms a clip that hinges at the necked region having a releasable latch operable by fastening and unfastening of the latching components. The clip serves to capture and retain the pouch. The clip may be fastened in some manner to the pouch.

In another aspect of the invention, an automated process for assembling a flexible container with a clip is disclosed. A flexible container having an interior, an exterior, and at least one opening from the exterior to the interior is provided along with a first and a second clip member having a clamping surface, a latching component, and a hinge component. Each is continuously moved until the first and the second clip members are in aligned, spaced apart relation with the clamping surfaces, latching components, and hinge components disposed one toward the other and the container is positioned between the clamping surfaces of the clip members. The clip members are joined semi-permanently together by fastening the hinge component of the first clip member to the hinge component of the is second clip member. This results in a clip with a hinge at one end and a releasable latch at another end. The releasable latch being operable by fastening and unfastening of the latching components. The clip serves to capture and retain the flexible container between the clamping surfaces of the clip members for selectively opening and closing the opening to the interior of the container.

Yet another aspect of the present invention discloses a process for automating assembly of a flexible material with a clip for attaching to the flexible material.

In another aspect, the present invention discloses a refillable pouch and clip arrangement. A refillable pouch having a plurality of sealed sides and an open end is provided. First and second clip members each having a clamping surface, a latching component, and a hinge component are mechanically manipulated into a desired orientation. At least one of the hinge components of one of the clip members has a necked region proximate to one end. The necked region being a thin flexible portion of the respective clip member. The first and the second clip members are positioned in aligned, spaced apart relation with the clamping surfaces, latching components, and hinge components being disposed one toward the other. The pouch is disposed between the clamping surfaces proximate to the open end. The first and second clip members are fastened together by joining the hinge components to form a clip having a hinge end and a releasable latch end for capturing and retaining the pouch between the clamping surfaces of the clip members. The flexible neck hinging the first and second clip members together.

Another aspect of the present invention discloses a pouch sealed against leakage by a clip. The pouch has a plurality of sealed sides and an open end which is sealed against leakage by a clip. The clip serves to secure a portion of the pouch between clamping surfaces associated with the clip. The clip has two clip members which are rigidly joined at one end to form a connecting end. The clip also has a necked region disposed upon at least one of the clip members proximate to the connecting end. The necked region serves to hinge the clip selectively open and closed to selectively seal and unseal the pouch. The connecting end is formed by loading each clip member into a feed mechanism for subsequent mechanical manipulation and dispense into aligned, spaced apart relation with the pouch disposed between the individual clip members. This allows the ends to be rigidly joined and the clip can be subsequently fastened so that the pouch is positioned between the clamping surfaces.

DESCRIPTION OF THE INVENTION

Figure 1:
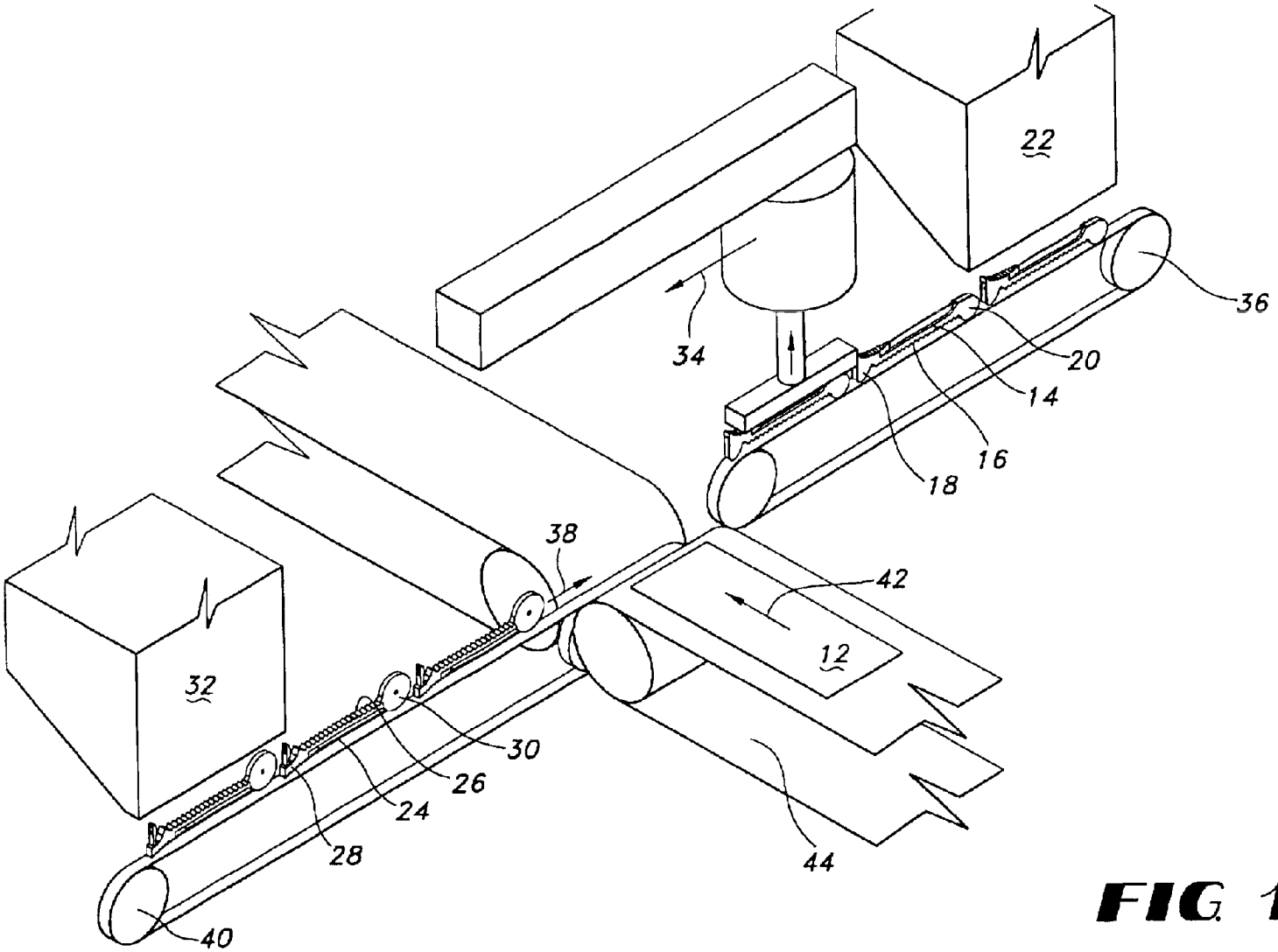
FIG. 1 is an overview of the process of the present invention.

The present invention and its advantages are best understood by referring to the drawings, like numerals being used for like and corresponding parts of the various drawings.

With reference to FIGS. 1 through 5, the present invention provides a process for automating the assembly of a clip 10 with a product 12. Automating the assembly results in both an increase in the quantity of finished products available per unit of time and a per unit cost savings when compared to the costs associated with workers manually attaching the clips 10 to the product 12.

In FIG. 1, a first clip member 14 having a clamping surface 16 disposed between a latching component 18 and a hinge component 20 is loaded into a first feed mechanism 22. Similarly a second clip member 24 having a clamping surface 26 disposed between a latching component 28 and a hinge component 30 is loaded into a second feed mechanism 32. Each of the clip members 14 and 24 are mechanically manipulated into a desired orientation. Manipulation of the clip members may be accomplished by any suitable manner well known in the art, including the use of vibration, centrifugal force, gravity, etc. As an alternative, the clip members 14 and 24 may be preoriented at the time they are loaded into their respective feeding mechanisms.

The feed mechanisms 22 and 32 in some embodiments may be bowl-type feeders. In other embodiments, the feed mechanisms may be adapted to accept cartridges (not shown) containing preoriented clip members 14 and/or 24 for loading. Other embodiments may include a single feed mechanism capable of sorting and properly orienting each clip member prior to assembly. Therefore, it should be understood that the specific form of feed mechanism or the manner in which it functions is not critical to the invention at hand. As such the feed mechanisms may take on any form understood in the art as being capable of achieving the task described.

The first clip member 14 is moved in a first direction 34 on a conveyor mechanism 36. Similarly, the second clip member 24 is moved in a second direction 38 on a conveyor mechanism 40. Though, in FIG. 1 the directions 34 and 38 are depicted as differing, it should be understood that there is no requirement that they differ. In fact, some embodiments would locate the first feed mechanism 22 proximate to the second feed mechanism 24. This arrangement makes it possible for the conveyor mechanisms 36 and 40 to operate such that feed directions 34 and 38 are the same.

Looking still to FIG. 1, it may be seen that the product 12 is moved in a third direction 42 along a conveyor mechanism 44. Each component, the first clip member 14, the second clip member 24, and the product 12 are continuously moved along their respective conveyor mechanisms in their respective directions. The clip members 14 and 24 and/or the product 12 may rest upon their respective conveyor mechanisms 36, 40, and 44 by gravity. Alternatively, any one of these components may be transported in its respective direction by means of vacuum attachment. Moreover, it should be understood that the transport of the components as well as their direction of travel may be accomplished by any suitable manner well known in the art.

Figure 2:
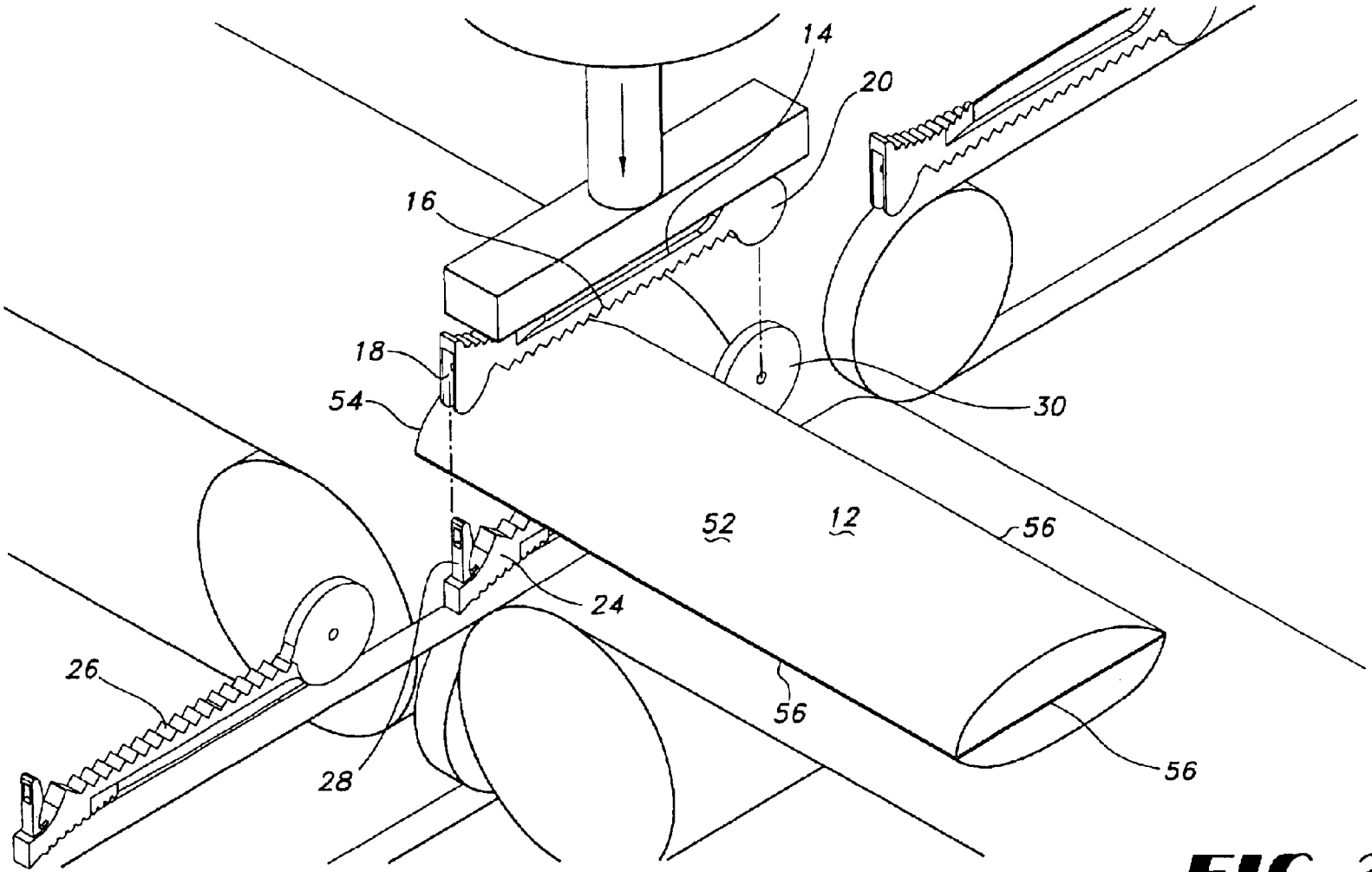
FIG. 2 is a detailed view of the FIG. 1 process depicting first and second clip members in place for fastening onto a pouch.

At a point in time, as shown in FIG. 2, each component reaches a desired location where the first and second clip members 14 and 24 are positioned in aligned, spaced apart relation with the clamping surfaces 16 and 26 disposed toward one another. By this point, the clip members 14 and 24 also are positioned in such a manner so that the latching components 18 and 28 as well as the hinge components 20 and 30 are also disposed one toward the other. The relative orientation of one clip member with respect to the other enables the clip members 14 and 24 to be joined together to form the clip 10.

Once the clip members 14 and 24 are oriented as described, and the product 12 is situated between the two clip members, the first and second clip members 14 and 24 are joined together by fastening the hinge component 20 of the first clip member 14 with the hinge component 30 of the second clip member 24. In some embodiments, such as that shown in FIG. 5, the design of the hinge components 20 and 30 are such that once joined they are permanently fastened together. This may be accomplished by among other means, the application of an adhesive, ultrasonic welding, or heat bonding of one material to the other.

Figure 3:
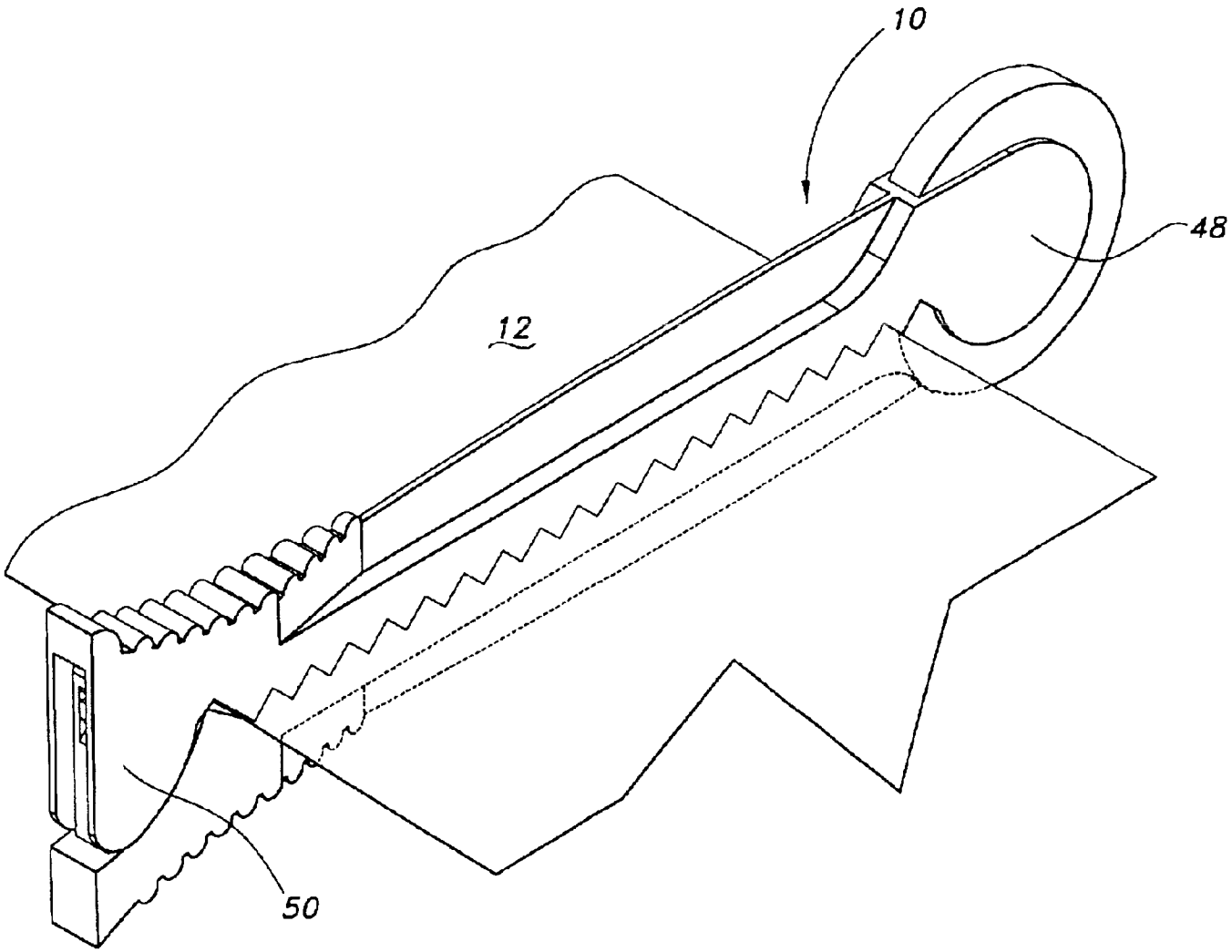
FIG. 3 depicts one possible embodiment of the final clip configuration after fastening to the pouch.
Figure 4:
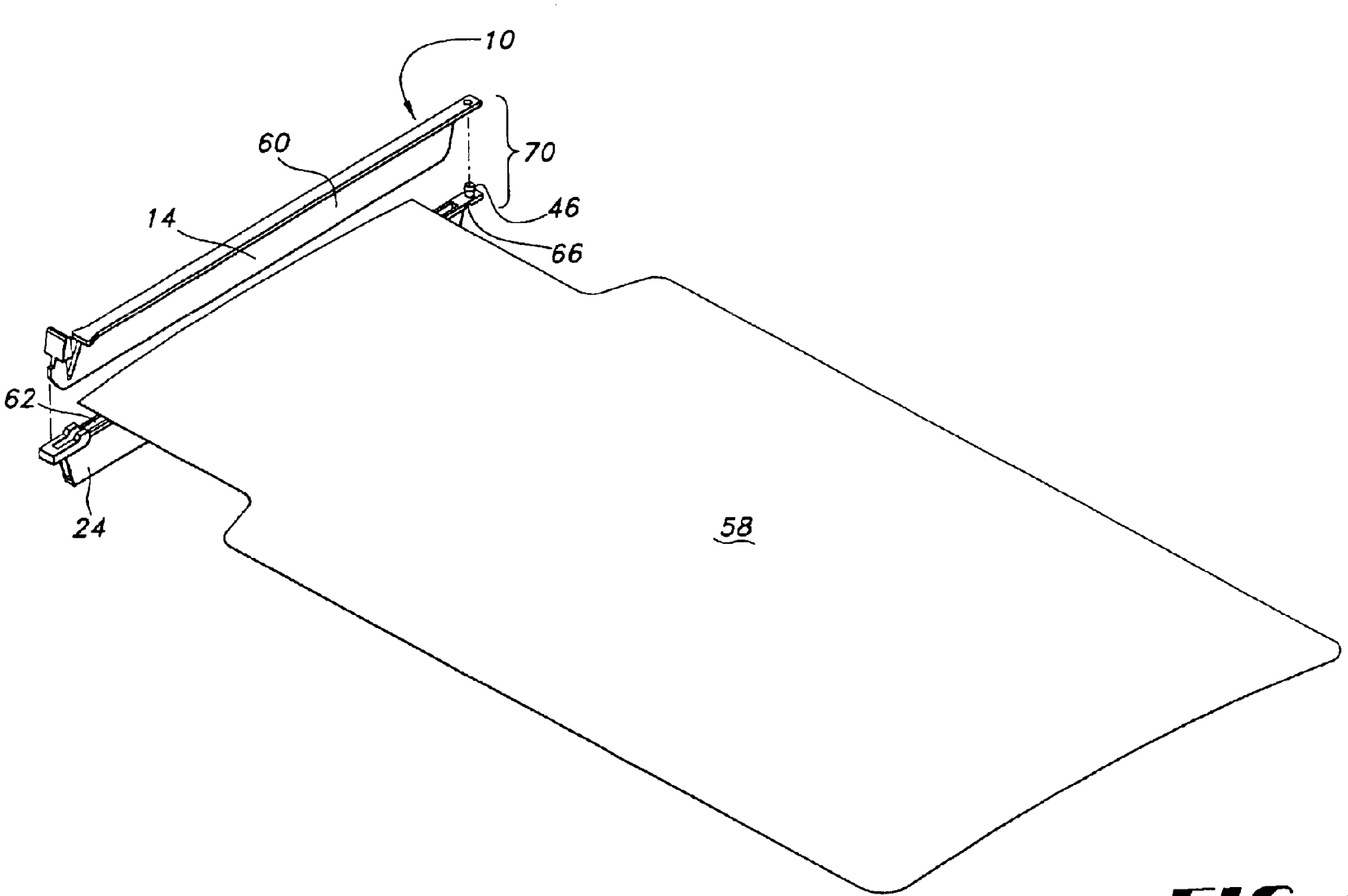
FIG. 4 shows another embodiment of the clip in relation to an ice pack.

In some clip embodiments, including the ones depicted in FIGS. 3 and 4, the hinge components 20 and 30 are semi-permanently fastened to one another. This may be accomplished in any way known to those skilled in the art, including through the use of fasteners 46 such as shown in FIG. 4. The fasteners 46 may be configured in a number of possible configurations such as bayonet-type fasteners, snaps, clips, in addition to other male-to-female connections. Once fastened, these semi-permanent types of fasteners 46 are designed to remain in a fastened condition. However, should there exist reason to separate them, the process of separating them should not destroy their integrity.

Turning once again to FIG. 3, it can be seen that with the hinge components 20 and 30 joined as described above, the clip 10 is provided with a hinge 48. Additionally, the latching components 18 and 28 interact with one another so that in combination, they form a latch 50. The latch 50 is adapted to alternatively latch or unlatch the clip 10. As such, the product 12 once situated between the clamping surfaces 16 and 26 of the clip 10 may be retained by the clip 10.

In some embodiments, once the clip members 14 and 24 are fastened via the hinge 48, the latch 50 may not be immediately secured. It may be desirable to allow the clip 10 to remain in an open, unlatched position. As such, another practical configuration allows the clip 10 to be adhered either permanently or temporarily to the product 12. For instance, the clip 10 can be adhered through the application of an adhesive tape (not shown) to at least one portion of the clip 10 so as to secure it to the product 12. Alternatively, a hot melt or cold adhesive can be applied in the same manner to secure the clip 10 to the product 12.

The product 12 can be made in limitless configurations. In some embodiments, such as that shown in FIG. 1, the product 12 may be a length of material such as a flexible fabric made of natural or synthetic fibers. Other embodiments such as shown in FIG. 2 envision the product 12 to be in the form of a container 52 having at least one open end 54 and a plurality of sealed sides 56. Such a container 52 may be constructed of a material capable of containing fluids, such as liquids. The container 52 may be adapted to contain fluids under pressure. As such, the design of the clip 10 should be capable of securing the container against leakage.

Clips 10 and containers 52 of the sort described are suitable for use in the medical industry among other fields. For example, containers of the present construction are adapted for use as saline bags, colostomy pouches, reusable ice packs and the like.

In one aspect of the invention, depicted in FIG. 4 automated assembly of the clip with an ice pack 58 is depicted. The process described above may be used. However, in order to maintain a liquid seal on the ice pack 58, the clip 10 may be configured into a blade and trough arrangement. That is, in one possible configuration, one of the clip members 14 or 24 is configured into the shape of a substantially planar blade 60. As such, the remaining clip member is configured into a trough 62 within which the blade 60 resides. This trough and blade arrangement serves as the clamping surfaces 16 and 26 earlier described. As such, the ice pack 58 is captured between the blade 60 and trough 62.

Figure 5:
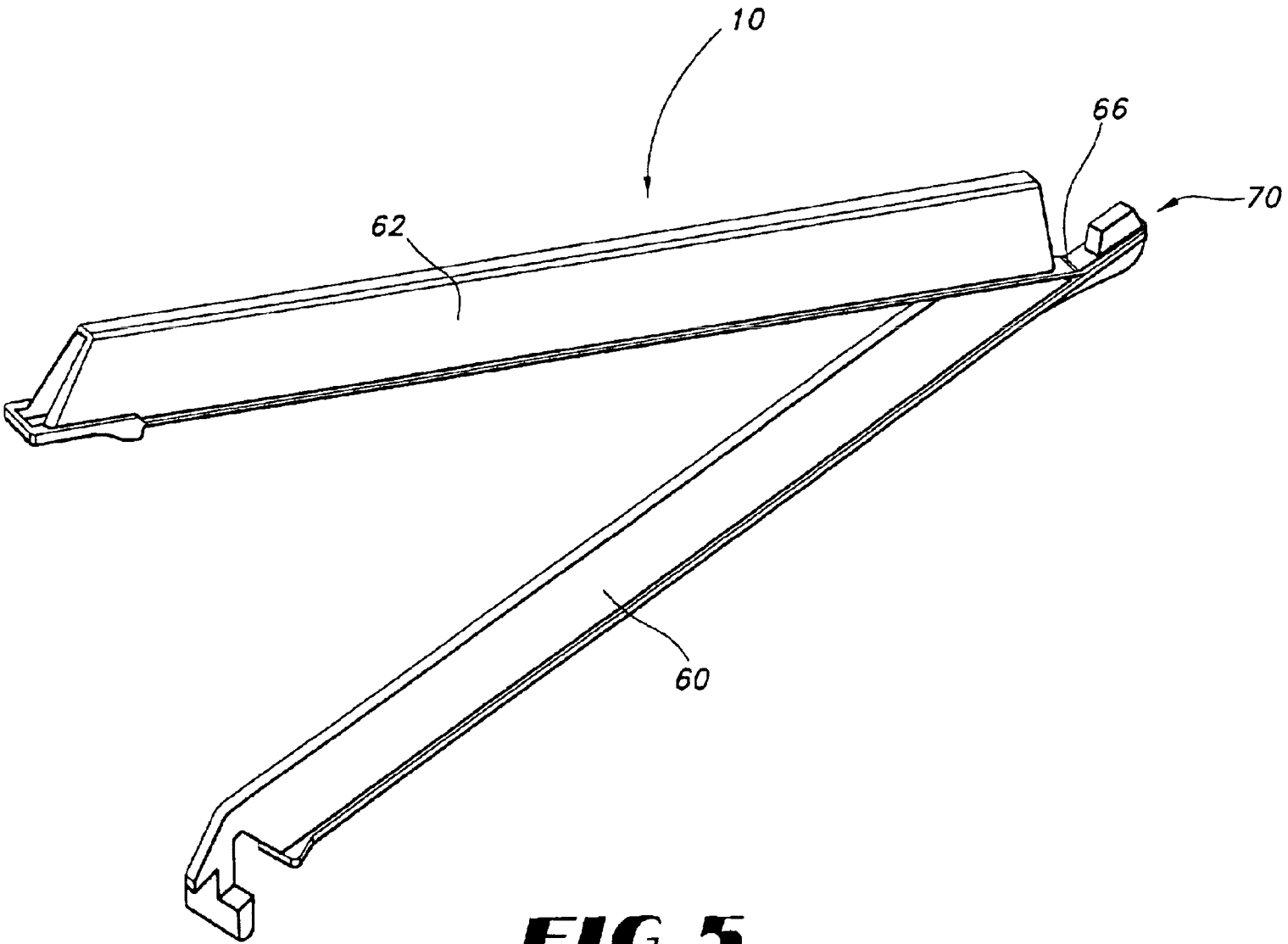
FIG. 5 shows an alternative embodiment of the rigid connection end of the clip of the present invention.

In FIG. 5, another embodiment of a clip 10 is shown. To enable the blade 60 and trough 62 to hinge properly, a necked region 66 may be provided proximate to one end of either clip member 14 and/or 24. The necked region 66 may be made sufficiently thin and flexible as compared to the remainder of the clip member upon which it is located so as to force the necked region 66 to serve as a flexible hinge once the clip 10 is assembled. The clip 10 is assembled by joining the blade 60 to the trough 62 at ends 70. The necked region 66 enables the clip 10 to open and close even though the first and second clip members 14 and 24 are otherwise fastened together at one end. In some embodiments, the necked region 66 enables the clip to hinge in substantially one plane. The necked region 66 can be thinned in either thickness, width, or both when compared to the remainder of the clip member 14 and/or 24.

Although the present invention and its advantages have been described in detail, it should be understood that various changes, substitutions, and alterations can be made therein without departing from the spirit and scope of the invention as defined by the appended claims.

What is claimed is:

1. A process for automating the positioning and fastening of a clip to a pouch comprising:

providing a first clip member having ends, a clamping surface, a latching component, and a hinge component comprising a necked region disposed proximate to one of the ends;

providing a second clip member having a clamping surface, a latching component, and a hinge component;

loading the first clip member into a first feed mechanism;

loading the second clip member into a second feed mechanism;

mechanically manipulating the first clip member within the first feed mechanism into a desired orientation;

mechanically manipulating the second clip member within the second feed mechanism into a desired orientation;

providing a pouch having a plurality of sealed sides and an open end;

dispensing the first and the second clip members in aligned, spaced apart relation with the clamping surfaces disposed one toward the other and the latching components and hinge components respectively disposed one toward the other;

positioning the pouch at a location proximate to the open end between the clamping surfaces of the first and second clip members;

joining the first and second clip members together by fastening the hinge component of the first clip member to the hinge component of the second clip member forming a clip that hinges at the necked region having a releasable latch operable by the selective fastening and unfastening of the latching components, the clip for capturing and retaining the pouch between the clamping surfaces of the clip members; and fastening the assembled clip to the pouch.

2. The process of claim 1 wherein the pouch is suitable for use in the medical field.

3. The process of claim 1 wherein the pouch is an ice pack.

4. The process of claim 1 wherein the pouch is adapted to contain a liquid.

5. Th process of claim 1 wherein the mechanical manipulation of the clip members is accomplished through vibrational orientation.

6. The process of claim 1 wherein the mechanical manipulation of the clip members is accomplished through centrifugal force.

7. The process of claim 1 wherein the clip members are preloaded into cartridges containing a plurality of such clip members.

8. The process of claim 1 wherein fastening the hinge components is accomplished through ultrasonic bonding.

9. The process of claim 1 wherein fastening the hinge components is accomplished through the application of heat.

10. The process of claim 1 wherein fastening the hinge components is accomplished by engaging a male connector with a female receiver.

11. The process of claim 1 further comprising adhering at least one clip member to the pouch.

12. The process of claim 11 further comprising adhesive tape to adhere the at least one clip member to the pouch.

13. The process of claim 11 further comprising adhesive to adhere the at least one clip member to the pouch.

14. The process of claim 13 wherein the adhesive is a hot melt adhesive.

* * * * *